US012247323B2

(12) United States Patent
Li et al.

(10) Patent No.: US 12,247,323 B2
(45) Date of Patent: Mar. 11, 2025

(54) CONTINUOUS PREPARATION METHOD OF CELLULOSE FIBERS

(71) Applicant: CHINA TEXTILE ACADEMY, Beijing (CN)

(72) Inventors: Ting Li, Beijing (CN); Chenxi Zhang, Beijing (CN); Chunzu Cheng, Beijing (CN); Mingming Zhang, Beijing (CN); Jigang Xu, Beijing (CN); Kedong Chi, Beijing (CN)

(73) Assignee: CHINA TEXTILE ACADEMY, Beijing (CN)

( * ) Notice: Subject to any disclaimer, the term of this patent is extended or adjusted under 35 U.S.C. 154(b) by 250 days.

(21) Appl. No.: 17/790,115

(22) PCT Filed: Nov. 19, 2020

(86) PCT No.: PCT/CN2020/129941
§ 371 (c)(1),
(2) Date: Jun. 29, 2022

(87) PCT Pub. No.: WO2021/135705
PCT Pub. Date: Jul. 8, 2021

(65) Prior Publication Data

US 2023/0042125 A1 Feb. 9, 2023

(30) Foreign Application Priority Data

Dec. 31, 2019 (CN) ..... 201911418063.8

(51) Int. Cl.
*D01D 1/02* (2006.01)
*D01D 5/06* (2006.01)
(Continued)

(52) U.S. Cl.
CPC ..... *D01F 2/00* (2013.01); *D01D 5/06* (2013.01); *D01D 5/12* (2013.01); *D01D 5/26* (2013.01);
(Continued)

(58) Field of Classification Search
CPC .. D01D 1/02; D01D 5/06; D01D 5/26; D01D 7/00; D01D 10/06; D01F 2/00;
(Continued)

(56) References Cited

U.S. PATENT DOCUMENTS 2,893,821 A * 7/1959 Elling ..... B60C 9/0042 264/194
2,988,777 A * 6/1961 Roman ..... D01D 5/06 264/180
(Continued)

FOREIGN PATENT DOCUMENTS

CN 1180385 A 4/1998
CN 1205746 A 1/1999
(Continued)

OTHER PUBLICATIONS

1 The family AT Grant notice issued on Oct. 16, 2023.

*Primary Examiner* — Leo B Tentoni
(74) *Attorney, Agent, or Firm* — The Sun IP Law

(57) ABSTRACT

Disclosed is a continuous preparation method of cellulose fibers, in which a forming tension of 0.1 to 1.9 cN/dtex is applied to a fine solution stream obtained by extrusion through a spinneret plate and air gap cooling, then the fine solution stream is fed into a coagulating bath at a speed of 80 to 1000 m/min, a traction tension of 0.075 to 1.5 cN/dtex is continued to be applied to washed fibers in a water washing system behind the coagulating bath, and finally, the
(Continued)

washed fibers are fed into a post-treatment system for continuous and efficient spinning of finished fibers at a speed of 80 to 1000 m/min.

18 Claims, 2 Drawing Sheets

(51) Int. Cl.

| | |
|---|---|
| ***D01D 5/12*** | (2006.01) |
| ***D01D 5/26*** | (2006.01) |
| ***D01D 7/00*** | (2006.01) |
| ***D01D 10/06*** | (2006.01) |
| ***D01F 2/00*** | (2006.01) |
| ***D01F 2/24*** | (2006.01) |

(52) U.S. Cl.
CPC ..... *D01D 10/06* (2013.01); *D10B 2201/22* (2013.01); *D10B 2201/28* (2013.01)

(58) Field of Classification Search
CPC ..... D01F 2/02; D01F 2/24; D10B 2201/20; D10B 2201/22; D10B 2201/28
USPC ..... 264/143, 180, 187, 203, 178 F, 211.12, 264/211.14, 211.15, 233
See application file for complete search history.

(56) References Cited

U.S. PATENT DOCUMENTS

| | | | | |
|---|---|---|---|---|
| 4,159,299 | A * | 6/1979 | Serkov | D01D 5/06 264/180 |
| 2020/0332442 | A1 * | 10/2020 | Schrempf | D01D 5/06 |

FOREIGN PATENT DOCUMENTS

| | | | |
|---|---|---|---|
| CN | 101289762 | A | 10/2008 |
| CN | 102317515 | A | 1/2012 |
| CN | 102477591 | A | 5/2012 |
| CN | 103025931 | A | 4/2013 |
| CN | 203174232 | A | 9/2013 |
| CN | 104420008 | A | 3/2015 |
| CN | 105671659 | A | 6/2016 |
| CN | 107955985 | A | 4/2018 |
| CN | 109537074 | A | 3/2019 |
| CN | 110453306 | A | 11/2019 |
| CN | 110578179 | A | 12/2019 |
| CN | 111555183 | A | 8/2020 |
| EP | 2589689 | A2 | 5/2013 |
| JP | 54120726 | A | 4/1981 |
| JP | 2003221728 | A | 8/2003 |

* cited by examiner

CONTINUOUS PREPARATION METHOD OF CELLULOSE FIBERS

The present application is a National Stage of International Patent Application No. PCT/CN2020/129941 filed on Nov. 19, 2020, the disclosures of which is incorporated by reference in their entirety.

TECHNICAL FIELD

The disclosure belongs to the technical field of cellulose fibers, and particularly relates to a continuous preparation method of cellulose fibers.

BACKGROUND

In the existing industry, the spinning speed of cellulose staple fibers by a new solvent method is about 40 m/min, the spinning speed of cellulose filaments is below 200 m/min, the production efficiency is low, the production cost is high, and thus the large-scale high-profit industrial popularization is difficult. Cellulose fibers are different from other varieties of fibers, and the characteristic of easy fibrillation of the cellulose fibers not only restricts the improvement of the spinning speed, but also influences the production process stability and the application field of the fibers. Low-speed preparation means poor economic benefit, but along with the improvement of the spinning speed, the fibrillation of the fibers is obvious in the preparation process, meanwhile, equipment has serious damage to the fibers, the uniformity becomes poor, and therefore, it is difficult to improve the spinning speed. In addition, under the condition of high-spinning-speed preparation of the cellulose fibers, the dry elongation is low, and the quality of the fibers is reduced, which is not conducive to the subsequent development and application, and limits the continuous and efficient preparation and popularization of the cellulose fibers.

In view of this, the disclosure is specifically proposed.

SUMMARY

The disclosure aims to overcome the defects of the prior art, and provides an efficient and continuous preparation technology of cellulose fibers. The purpose of stable, continuous and high-speed spinning is achieved by regulating and controlling the optimum tension of each section of cellulose fiber forming by a new solvent method. In the preparation process of the cellulose fibers, due to the optimum tension of each section and the sequential matching of the tension of each section for use, the mechanical abrasion for preparing each section can be reduced, the degree of fibrillation can be controlled to be minimum, the uniformity of tows can be improved, and the stability of fiber preparation and the quality of the fibers can be improved.

In order to achieve the technical purpose, the disclosure adopts the following technical solutions.

The disclosure provides a continuous preparation method of cellulose fibers, in which a forming tension of 0.1 to 1.9 cN/dtex is applied to a fine solution stream obtained by extrusion through a spinneret plate and air gap cooling, then the fine solution stream is fed into a coagulating bath at a speed of 80 to 1000 m/min, a traction tension of 0.075 to 1.5 cN/dtex is continued to be applied to washed fibers in a water washing system after the coagulating bath, and finally, the washed fibers are fed into a post-treatment system for continuous spinning to obtain finished fibers.

In the technical solution, a coagulating system adopts the coagulating bath with the flowing speed, which is consistent with the trend of the fine solution stream (tows), so that the resistance and abrasion of bath liquid to the tows in the coagulating phase separation process of the tows can be reduced. In the process of high-speed spinning, the forming process can be regulated by regulating and controlling the difference between the flow speed of the coagulating bath and the drawing speed of the tows (the spinning speed of the tows), namely regulating and controlling the forming tension, and thus the damage and fibrillation can be reduced on the premise of ensuring the full forming of the fibers.

According to the preparation method, the temperature of the spinning stock solution, the pore diameter of the spinneret plate, the air gap cooling condition and the coagulating double-diffusion condition are adjusted according to the speed of the coagulating bath, meanwhile, the process conditions of the post-treatment system are adjusted, so that the cellulose fibers are subjected to tension suitable for all preparation stages, and the finished fibers are continuously spun by the tows at the spinning speed of 80 to 1000 m/min. Preferably, the spinning speed is not smaller than the speed of the coagulating bath; and more preferably, the spinning speed is slightly higher than the speed of the coagulating bath.

According to the technical solution, under other appropriate process conditions (air gap height, blowing conditions and the like), forming tension is optimized, then differential reduction of the flow speed of the coagulating bath and the drawing speed of the tows can be realized, on the premise that the tows can be smoothly separated from the coagulating bath, the action resistance of the coagulating bath to high-speed tows in the double-diffusion forming process is reduced, fibrillation is reduced, and optimization of fiber quality of the forming section is achieved; and the traction tension is optimized, so that the abrasion in the stroke of the fibers can be reduced, the fibrillation can be reduced, and the stability and continuity of the preparation process can be improved. The cellulose fibers prepared according to the preferred technical solution is more excellent in performance and more continuous and efficient.

According to the preparation method, a forming tension of 0.15 to 0.65 cN/dtex is applied to the fine solution stream obtained by extrusion through a spinneret plate and air gap cooling, then the fine solution stream is fed into a coagulating bath at a speed of 200 to 800 m/min, a traction tension of 0.1 to 0.6 cN/dtex is continued to be applied to washed fibers in a water washing system after the coagulating bath, and finally, the washed fibers are fed into a post-treatment system to prepare finished fibers. Preferably, the fine solution stream is subjected to a forming tension of 0.2 to 0.6 cN/dtex, the washed fibers are subjected to a traction tension of 0.15 to 0.55 cN/dtex, and tows are continuously spun into the finished fibers at the spinning speed of 200 to 800 m/min through the preparation method.

According to the technical solution, the disclosure is more suitable for spinning fibers at the speed of 200 to 800 m/min, and by matching the temperature of the spinning stock solution, the pore diameter of the spinneret plate, the air gap cooling condition and the speed of the high-speed coagulating bath, the forming tension of 0.2 to 0.6 cN/dtex is applied to the fine solution stream; and then by adjusting the post-treatment system equipment, the washed tows are subjected to the traction tension of 0.15 to 0.55 cN/dtex, so that the cellulose fibers are continuously spun at the speed of 200 to 800 m/min.

According to the preparation method, the water washing system adopts a spraying or soaking water washing mode, and preferably, the water flowing direction of water washing is consistent with the direction of the tows; and preferably, the cellulose filaments are washed in a combined form. Roller washing spraying or tow washing spraying can be selected for spraying, or combined use can be adopted; and the spraying direction is adjusted according to the water washing effect, preferably, a spraying direction at an acute angle or consistent with the direction of the tows. Roller soaking or tow soaking can be selected for soaking, or combined use can be adopted; preferably, soaking adopts a flowing water form, and countercurrent soaking water washing can be selected to improve the water washing effect, namely, the flowing direction of flowing water is opposite to the direction of tows; and in order to reduce high-speed abrasion, same-directional soaking can also be selected.

According to the preparation method, the post-treatment system includes two independent working sections for preparing cellulose filaments or cellulose staple fibers; the working section of the cellulose filaments comprises an oiling system and a drying section which are sequentially disposed, and then the treated fibers are wound into a filament cylinder finished product; preferably, the working section of the cellulose filaments includes a pre-drying section, an oiling system and a main drying section which are sequentially disposed; and the working section of the cellulose staple fibers comprises a cutting section, a water washing section, an oiling system, a drying section and a packaging section which are disposed in sequence.

According to the preparation method, when the cellulose filaments are prepared, the dried tows are subjected to a traction tension of 0.025 to 2.25 cN/dtex; and preferably, the dried tows are subjected to a traction tension of 0.06 to 1 cN/dtex. By applying the appropriate traction tension to the dried tows, the tows can be stably wound into a filament cylinder.

According to the preparation method, the spraying direction of the coagulating bath is consistent with the running direction of the fine solution stream; and preferably, the spraying direction of the coagulating bath is parallel to the running direction of the fine solution stream.

According to the technical solution, in the prior art, atomized coagulating bath liquid drops are sprayed to the surfaces of the fibers at a certain included angle with the running direction of the fibers, and are parallel to the heat transfer and mass transfer direction from the interior to the surfaces of filaments, namely are sprayed perpendicular to the cross sections of the fibers. With the mode, although the cooling and solidification are more uniform, due to the fact that the spraying direction is different from the running direction of the fiber, the generated resistance can affect the increase of the spinning speed, and if the spinning speed continues to be improved, the phenomenon of fibrillation can be aggravated. In the disclosure, by adopting the spraying mode with the spraying direction consistent with the running direction of the fibers, the resistance of the atomized liquid drops is reduced, and the damage and degree of fibrillation of the fibers are reduced.

According to the preparation method, the coagulating bath further comprises a coagulating bath water tank disposed at an outlet of the tows, the coagulating bath water tank comprises a filament guide system, and the outlet of the tows is disposed vertically extending downwards into the water tank, or is disposed along the liquid level of the water tank, or is disposed bending upwards along the liquid level of the water tank, or is disposed bending upwards from a position lower than the liquid level of the water tank, or is disposed higher than the liquid level of the water tank, so that the fiber tows passing through the coagulating bath are completely immersed, or partially immersed, or do not pass through the coagulating bath water tank.

In the technical solution, the angle of the outlet of the tows of the coagulating bath is adjustable, and corresponding adjustment can be made according to different fiber types, so that the tows are completely immersed, partially immersed or not treated by the coagulating bath water tank.

According to the preparation method, the soaking length of the fiber tows through the coagulating bath is 50 to 1500 mm, preferably 100 to 350 mm. The soaking length is the length of the tows immersed in the coagulating bath.

According to the preparation method, the coagulating bath water tank is provided with a filament guide system, a filament guide part of the filament guide system comprises one or more of driving double rollers, a single-roller combined filament separating roller, a rod and a hook, and preferably, the filament guide part is the driving double rollers.

According to the preparation method, the driving double roller or single roller is provided with a motor, and the rotating speed of the roller is the spinning speed; the angles of the driving double rollers can be adjusted relative to a supporting plate, so that the respective axis extension lines of the driving double rollers are intersected, and the number of winding turns of the tows on the driving rollers is preferably not smaller than three.

In the technical solution, two rollers of the driving double rollers are not parallel and have a certain relative angle, the tows are wound on the driving rollers for a plurality of circles, enough holding force is realized to form tension application points, and thus the tension borne by the tows corresponding to each spinning head in industrial production is constant and uniform.

According to the preparation method, the filament guide system is installed below an outlet of the coagulating bath; and preferably, the filament guide system is disposed close to the lower portion of the outlet.

In the technical solution, the filament guide system is disposed close to the lower portion of the outlet, then the influence caused by the distance difference between a tension generation point and a stress point can be eliminated, and abrasion of water-filament separation to the fiber tows is relieved; and in order to ensure constant application of tension, the relative positions of the two rollers can be determined according to the actual space and the direction of the tows.

In the technical solution, the balance of the coagulating double-diffusion effect and the degree of fibrillation can be achieved by adjusting the number of winding turns of the tows on the double-roller filament guide part, whether the tows are immersed into the coagulating bath tank or not and the depth of the tows immersed into the coagulating bath tank, therefore, while the coagulating effect is guaranteed, the infiltration time of the fibers is shortened, and the degree of fibrillation is controlled to be low.

According to the preparation method, the pore diameter of the spinneret plate is 0.04 to 0.3 mm, preferably 0.08 to 0.2 mm.

According to the preparation method, the spinning stock solution is prepared by mixing, swelling and dissolving cellulose pulp and NMMO aqueous solution, the intrinsic viscosity of the cellulose pulp is preferably not higher than 600 mL/g, preferably 270 to 500 mL/g, and the cellulose can be selected from pulp with single intrinsic viscosity and can also be obtained by mixing cellulose pulp with difference in intrinsic viscosity; the cellulose content in the spinning stock solution is 5 to 15 wt %, preferably 7 to 13 wt %; and the temperature of the spinning stock solution is 90 to 130° C., preferably 100 to 125° C.

In the technical solution, the temperature of the spinning stock solution, the pore diameter of the spinneret plate, the air gap cooling height, the condition of cooling air and the coagulating condition all need to be adjusted along with the speed of the high-speed coagulating bath, so that the magnitude requirement of forming tension is met; and the post-treatment system also needs to be adjusted so as to meet the magnitude requirement of the traction tension.

According to the preparation method, the adjustment range of the air gap cooling height in the air gap cooling condition is 10 to 200 mm, preferably 35 to 125 mm. The humidity of the cooling air is absolutely dry 3 to 15 g/kg dry air, preferably absolutely dry 4 to 10 g/kg dry air; the temperature of the cooling air is 5 to 28° C., preferably 14 to 24° C.; and the speed of the cooling air is 3 to 35 m/s, preferably 3.5 to 10 m/s.

In the technical solution, the fine solution stream exchanges heat with the air in the air gap, so that the fine solution stream enters the coagulating bath after the surface of the fine solution stream is primarily cooled and solidified, and the increase of the spinning speed is limited by the influence of the mass transfer speed of the interior of the tows and between the bath solution. In the disclosure, the air gap cooling height, the humidity and temperature of the cooling air are controlled to be large within a certain range, the proper solidification is realized by combining the matching regulation and control of all the conditions of the cooling air and the air gap height, and the spinnability and the quality of the fibers are guaranteed while high-spinning-speed stretching is borne. Specifically, the preparation method provided by the disclosure includes the following steps.

(1) Mixing, swelling and dissolving are carried out on cellulose pulp and NMMO aqueous solution to prepare a spinning stock solution with the cellulose content of 7 to 13%, extruding is carried out through a spinneret plate with the pore diameter of 0.04 to 0.3 mm of a spinneret assembly at the spinning temperature of 90 to 130° C., through an air gap layer with the height of 10 to 200 mm, cooling is carried out under the conditions that the humidity of the cooling air is absolutely dry 3 to 15 g/kg dry air, the temperature is 5 to 28° C. and the speed is 3 to 35 m/s to obtain a fine solution stream, and the fine solution stream is subjected to forming tension of 0.1 to 1.9 cN/dtex.

(2) The fine solution stream in the step (1) is enabled to enter a high-speed coagulating system, the speed of a coagulating bath is 80 to 1000 m/min, the spraying direction of the coagulating bath is consistent with the direction of the fine solution stream (tows), so that the fine solution stream is coagulated and formed under the drawing of the high-speed coagulating bath, then nascent fibers are fed into a water washing system, and the washed fibers are subjected to traction tension of 0.075 to 1.5 cN/dtex.

(3) The washed fibers are fed into the post-treatment system for continuous spinning to obtain the fiber finished product.

By adopting the technical solutions, the disclosure has the following beneficial effects compared with the prior art.

1. For the continuous preparation method of cellulose fibers provided by the disclosure, the forming process of the fibers can be controlled by limiting the magnitude of the forming tension borne by the fibers, stable forming of the fibers is realized, and the structure and performance of the fibers are finally controlled. In the forming process, due to the matching of the speed of the high-speed coagulating bath, the spinning speed and the traction speed, namely the adjustment of the tension borne by the fibers, and the matched use of the tension front and back, the fiber damage at each stage can be reduced as much as possible, and the uniformity of the fibers is improved.

2. For the continuous preparation method of cellulose fibers provided by the disclosure, the drawing property of the spinning stock solution is optimized by combining with the temperature of the spinning stock solution, the forming multiple is optimized by combing with the pore diameter of the spinneret plate, the forming environment is optimized by combing with the air gap cooling height and the condition of air, and finally, appropriate forming conditions are compounded to achieve the optimal forming tension, a proper double-diffusion effect is realized in the shortest process under the coagulating condition, so that high-quality nascent fibers are prepared at a high speed. The nascent fiber enters the water washing system, and by adjusting the post-treatment process conditions, the magnitude of traction tension borne by the washed tows and even the magnitude of traction tension borne by the fibers in each stage of post-treatment are limited, so that the mechanical damage between the fibers and equipment at each stage can be controlled, the abrasion is reduced to the minimum, the infiltration time of each section of fiber is shortened, the degree of fibrillation is reduced, then stable preparation is facilitated, so that the high quality of the fiber finished product is kept.

3. For the continuous preparation method of cellulose fibers provided by the disclosure, stable adjustment of tension of each section of fiber preparation is realized by adjusting the temperature of the spinning stock solution, the pore diameter of the spinneret plate, the air gap cooling height, the condition of air, the speed of high-speed coagulating bath, the coagulating condition and the post-treatment system, a tension value which is most suitable for fiber forming and reduces mechanical abrasion of each section to the minimum is selected, thereby ensuring high quality and high performance of the cellulose fibers while realizing high-speed spinning and improving the production efficiency.

4. For the continuous preparation method of cellulose fibers provided by the disclosure, the filament guide system is disposed close to the lower portion of the outlet of the coagulating bath, then the influence caused by the distance difference between a tension generation point and a stress point can be eliminated, constant application of tension to each fiber is guaranteed, and abrasion of water-filament separation to the fiber tows is relieved. The balance of the coagulating double-diffusion effect and the degree of fibrillation can be achieved by adjusting the number of winding turns of the tows on the double-roller filament guide part, whether the tows are immersed into the coagulating bath tank or not and the depth of the tows immersed into the coagulating bath tank, therefore, while the coagulating effect is guaranteed, the infiltration time of the fibers is shortened, the degree of fibrillation is controlled to be low, and the quality of the fibers is guaranteed.

The specific implementation modes of the disclosure will be further described in detail below with reference to the drawings.

BRIEF DESCRIPTION OF THE DRAWINGS

The drawings, which form a part hereof, serve to provide a further understanding of the disclosure, and illustrative embodiments of the disclosure and descriptions thereof serve to explain the disclosure and are not to be construed as unduly limiting the disclosure. Obviously, the drawings described below are only some embodiments of the disclosure, and other drawings can further be obtained by those of ordinary skill in the art according to the drawings without creative work. In the drawings.

In the figures, 1. Spinning assembly, 2. High-speed coagulating system, 21. Outlet of tows of a coagulating bath, 22. Coagulating bath water tank, 23. Filament guide system, 3. Air gap cooling, 4. Water washing system, 5. Post-treatment system, 6. Pre-drying section, 7. Oiling system, 8. Main drying section, and 9. Winding and filament collecting device.

It is to be noted that the drawings and written description are not intended to limit the concept scope of the disclosure in any way, but rather to illustrate the concept of the disclosure to those skilled in the art by reference to specific embodiments.

DETAILED DESCRIPTION OF THE EMBODIMENTS

In order to make the purpose, the technical solutions and the advantages of the embodiments of the disclosure clearer, the technical solutions in the embodiments of the disclosure will be clearly and completely described below in combination with the drawings in the embodiments of the disclosure, and the following embodiments are intended to illustrate the disclosure, rather to limit the scope of the disclosure.

Figure 1:
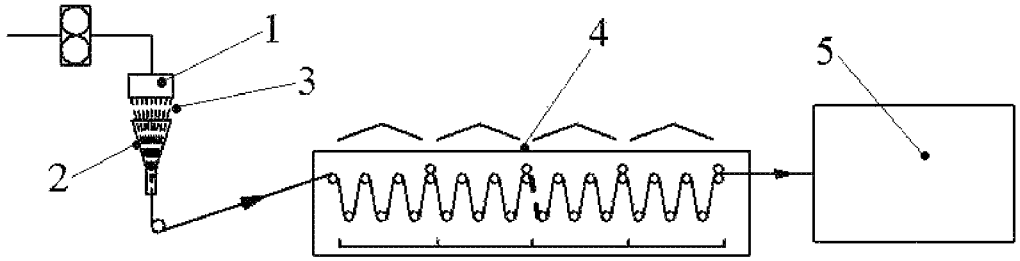
FIG. 1 is a schematic diagram of a flowchart device of a preparation method provided by the disclosure.
Figure 2:
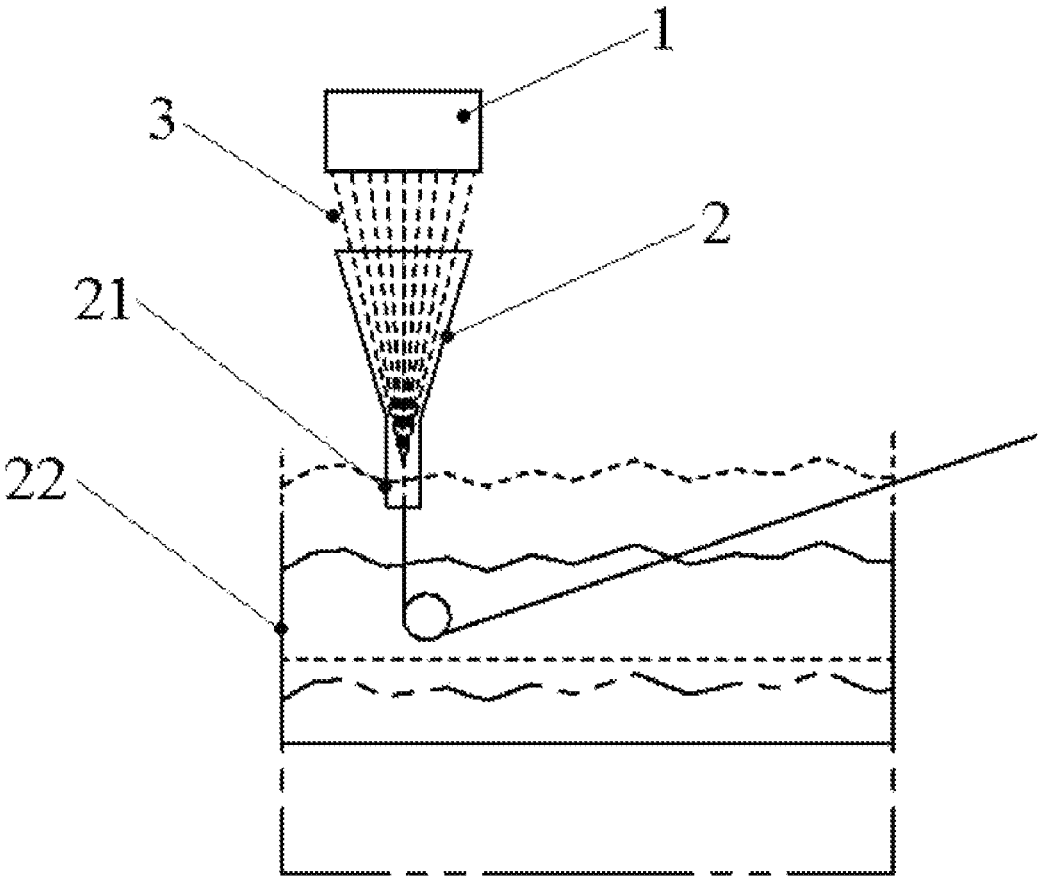
FIG. 2 is a schematic diagram of a high-speed coagulating system provided by the disclosure.
Figure 3:
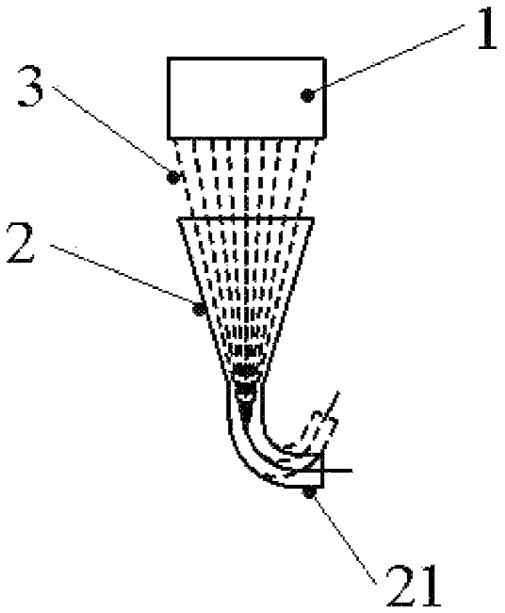
FIG. 3 is a schematic diagram of direction adjustment of an outlet of tows of a coagulating bath in a high-speed coagulating system provided by the disclosure.
Figure 4:
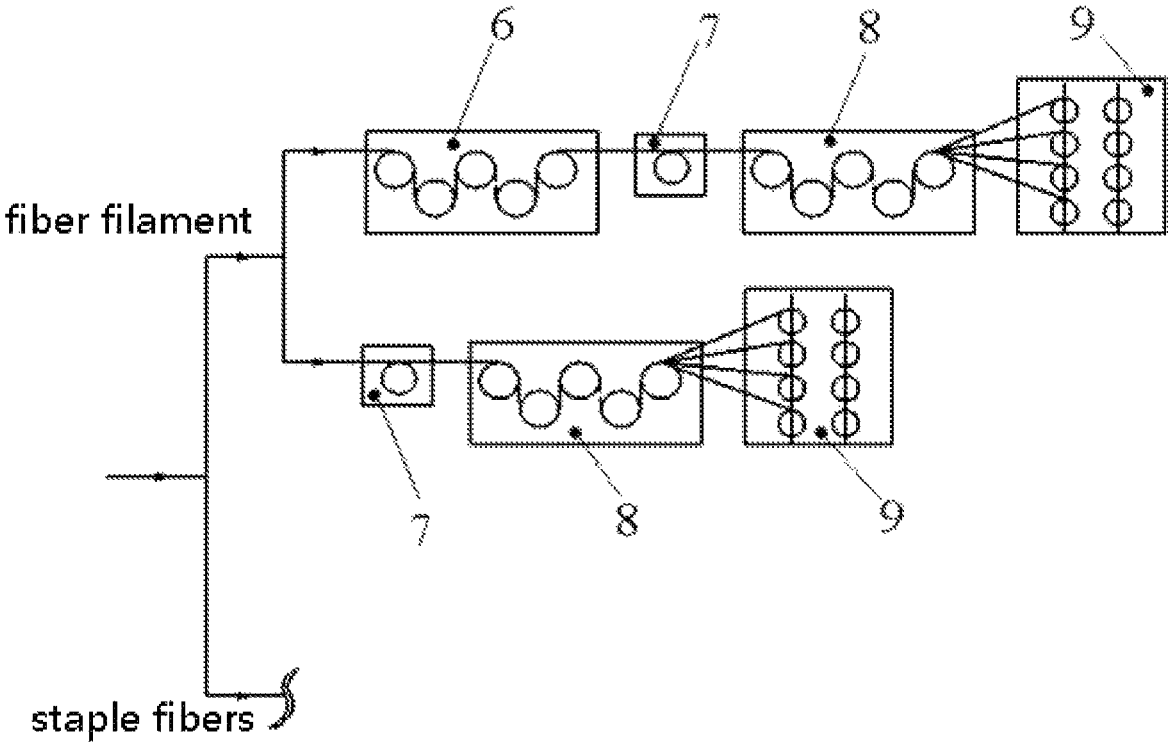
FIG. 4 is a schematic diagram of a post-treatment system of a preparation method provided by the disclosure.

As shown in FIGS. 1-4, an efficient and continuous preparation technology of cellulose fibers provided by the embodiments of the disclosure is specifically: mixing, swelling and dissolving are carried out on cellulose pulp and NMMO aqueous solution to prepare a spinning stock solution, extruding is carried out through a spinneret assembly, after cooling through an air gap layer, the fine solution stream enters a high-speed coagulating system, the direction of the coagulating bath is consistent with the direction of the fine solution stream (tows), so that the fine solution stream subjected to the forming tension is coagulated and formed under the drawing of the high-speed coagulating bath to obtain nascent fibers, the nascent fibers are washed by a water washing system to remove residual solvent, and then the water washed tows subjected to traction tension are treated by a post-treatment system, so that cellulose fiber finished products can be continuously spun. The post-treatment system can be a pre-drying section, an oiling system and a main drying section, or an oiling system and a drying section; the dried tows are subjected to traction tension, and then are formed into a filament cylinder finished product through a winding and filament collecting device, or sequentially pass through a cutting section, a water washing section, the oiling system, a drying section and packaging to obtain a finished product; and the cellulose fibers may be cellulose staple fibers or cellulose filaments. The high-speed coagulating system can be provided with a coagulating bath water tank, the path of the fiber tows is selected according to product requirements, and the tows can be immersed, partially immersed or without passing through the coagulating bath water tank after being subjected to high-speed coagulating bath; and the outlet of the high-speed coagulating bath can be vertically downward, or can be horizontal spraying or steered upward (the steering angle is selected according to the requirement of the path).

The coagulating bath water tank is provided with a filament guide system, a filament guide part of the filament guide system comprises one or more of driving double rollers, a single-roller combined filament separating roller, a rod and a hook, and the filament guide part is preferably the driving double rollers. The driving double rollers or single roller of the filament guide system is provided with a motor, and the rotating speed of the roller is the spinning speed; and the angles of the driving double rollers can be adjusted relative to a supporting plate, so that the respective axis extension lines of the driving double rollers are intersected, and the number of winding turns of the tows on the driving rollers is preferably not smaller than three. The two rollers of the driving double rollers are not parallel and have a certain relative angle, the tows are wound on the driving rollers for a plurality of circles, then enough holding force is realized to form tension application points, and thus the tension borne by the tows corresponding to each spinning head in industrial production is constant and uniform. The filament guide system is installed below an outlet of the coagulating bath; and preferably, the filament guide system is disposed close to the lower portion of the outlet. The filament guide system is disposed close to the lower portion of the outlet, then influence caused by the distance difference between a tension generation point and a stress point can be eliminated, and abrasion of water-filament separation to the fiber tows is relieved; and in order to ensure constant application of tension, the relative positions of the two rollers can be determined according to the actual space and the direction of the tows. The balance of the coagulating double-diffusion effect and the degree of fibrillation can be achieved by adjusting the number of winding turns of the tows on the double-roller filament guide part, whether the tows are immersed into the coagulating bath tank or not and the depth of the tows immersed into the coagulating bath tank, therefore, while the coagulating effect is guaranteed, the infiltration time of the fibers is shortened, and the degree of fibrillation is controlled to be low.

Embodiment 1

In the embodiment, the continuous spinning of cellulose fibers at a speed of 700 m/min is realized by adjusting the tension of the tows at each stage of preparation using the following continuous preparation method.

(1) Mixing, swelling and dissolving were carried out on cellulose pulp with the intrinsic viscosity of 500 mL/g and NMMO aqueous solution to prepare a spinning stock solution with the cellulose content of 13%, the spinning temperature was 115° C., extruding was carried out through a spinneret plate with the pore diameter of 0.08 mm of a spinneret assembly, through an air gap layer with the height of 80 mm, cooling was carried out under the conditions that cooling air was absolutely dry 3 g/kg dry air, the temperature of the air was 18° C. and the speed of the air was 20 m/s to obtain a fine solution stream, and the fine solution stream is subjected to a forming tension of 0.75 cN/dtex.

(2) The fine solution stream in the step (1) was enabled to enter a high-speed coagulating system, the speed of a coagulating bath was 600 m/min, the spraying direction of the coagulating bath was consistent with the direction of the fine solution stream (tows), so that the fine solution stream is coagulated and formed under the drawing of the high-speed coagulating bath, then nascent fibers were fed into a water washing system, and the washed fibers were subjected to traction tension of 0.058 cN/dtex.

(3) The fibers washed in the step (2) were fed into a post-treatment system, and prepared into cellulose filament finished products through a pre-drying section, an oiling system, a main drying section and a winding and filament collecting device, wherein the dried tows were subjected to traction tension of 0.08 cN/dtex.

Embodiment 2

In the embodiment, the continuous spinning of cellulose fibers at a speed of 240 m/min was realized by adjusting the tension of the tows at each stage of preparation using the following continuous preparation method.

(1) Mixing, swelling and dissolving were carried out on cellulose pulp with the intrinsic viscosity of 300 mL/g and NMMO aqueous solution to prepare a spinning stock solution with the cellulose content of 9%, the spinning temperature was 95° C., extruding was carried out through a spinneret plate with the pore diameter of 0.2 mm of a spinneret assembly, through an air gap layer with the height of 40 mm, cooling was carried out under the conditions that cooling air was absolutely dry 8 g/kg dry air, the temperature of the air was 28° C. and the speed of the air was 10 m/s to obtain a fine solution stream, and the fine solution stream was subjected to a forming tension of 0.84 cN/dtex.

(2) The fine solution stream in the step (1) was enabled to enter a high-speed coagulating system, the speed of a coagulating bath was 200 m/min, the spraying direction of the coagulating bath was consistent with the direction of the fine solution stream (tows), so that the fine solution stream was coagulated and formed under the drawing of the high-speed coagulating bath, then nascent fibers were fed into a water washing system, and the washed fibers were subjected to traction tension of 0.66 cN/dtex.

(3) The fibers washed in the step (2) were fed into a post-treatment system, and prepared into cellulose filament finished products through a pre-drying section, an oiling system, a main drying section and a winding and filament collecting device, wherein the dried tows were subjected to traction tension of 1.56 cN/dtex.

Embodiment 3

In the embodiment, the continuous spinning of cellulose fibers at a speed of 450 m/min was realized by adjusting the tension of the tows at each stage of preparation using the following continuous preparation method.

(1) Mixing, swelling and dissolving were carried out on cellulose pulp with the intrinsic viscosity of 300 mL/g and NMMO aqueous solution to prepare a spinning stock solution with the cellulose content of 12%, the spinning temperature was 100° C., extruding was carried out through a spinneret plate with the pore diameter of 0.3 mm of a spinneret assembly, through an air gap layer with the height of 60 mm, cooling was carried out under the conditions that cooling air was absolutely dry 5 g/kg dry air, the temperature of the air was 15° C. and the speed of the air was 5 m/s to obtain a fine solution stream, and the fine solution stream was subjected to a forming tension of 1.1 cN/dtex.

(2) The fine solution stream in the step (1) was enabled to enter a high-speed coagulating system, the speed of a coagulating bath was 400 m/min, the spraying direction of the coagulating bath was consistent with the direction of the fine solution stream (tows), so that the fine solution stream was coagulated and formed under the drawing of the high-speed coagulating bath, then nascent fibers were fed into a water washing system, and the washed fibers were subjected to traction tension of 0.85 cN/dtex.

(3) The fibers washed in the step (2) were fed into a post-treatment system, and prepared into cellulose filament finished products through a pre-drying section, an oiling system, a main drying section and winding and filament collecting device, wherein the dried tows were subjected to traction tension of 0.8 cN/dtex.

Embodiment 4

In the embodiment, the continuous spinning of cellulose fibers at a speed of 80 m/min was realized by adjusting the tension of the tows at each stage of preparation using the following continuous preparation method.

(1) Mixing, swelling and dissolving were carried out on cellulose pulp with the intrinsic viscosity of 540 mL/g and NMMO aqueous solution to prepare a spinning stock solution with the cellulose content of 7%, the spinning temperature was 90° C., extruding was carried out through a spinneret plate with the pore diameter of 0.075 mm of a spinneret assembly, through an air gap layer with the height of 20 mm, cooling was carried out under the conditions that cooling air was absolutely dry 15 g/kg dry air, the temperature of the air was 24° C. and the speed of the air was 3.5 m/s to obtain a fine solution stream, and the fine solution stream was subjected to a forming tension of 0.23 cN/dtex.

(2) The fine solution stream in the step (1) was enabled to enter a high-speed coagulating system, the speed of a coagulating bath was 80 m/min, the spraying direction of the coagulating bath was consistent with the direction of the fine solution stream (tows), so that the fine solution stream was coagulated and formed under the drawing of the high-speed coagulating bath, then nascent fibers were fed into a water washing system, and the washed fibers were subjected to traction tension of 0.11 cN/dtex.

(3) The fibers washed in the step (2) were fed into a post-treatment system, and prepared into cellulose filament finished products through a pre-drying section, an oiling system, a main drying section and a winding and filament collecting device, wherein the dried tows were subjected to traction tension of 2 cN/dtex.

Embodiment 5

In the embodiment, the continuous spinning of cellulose fibers at a speed of 900 m/min was realized by adjusting the tension of the tows at each stage of preparation using the following continuous preparation method.

(1) Mixing, swelling and dissolving were carried out on cellulose pulp with the intrinsic viscosity of 250 mL/g and NMMO aqueous solution to prepare a spinning stock solution with the cellulose content of 10%, the spinning temperature was 125° C., extruding was carried out through a spinneret plate with the pore diameter of 0.15 mm of a spinneret assembly, through an air gap layer with the height of 100 mm, cooling was carried out under the conditions that cooling air was absolutely dry 7 g/kg dry air, the temperature of the air was 14° C. and the speed of the air was 15 m/s to obtain a fine solution stream, and the fine solution stream was subjected to a forming tension of 0.63 cN/dtex.

(2) The fine solution stream in the step (1) was enabled to enter a high-speed coagulating system, the speed of a coagulating bath was 800 m/min, the spraying direction of the coagulating bath was consistent with the direction of the fine solution stream (tows), so that the fine solution stream was coagulated and formed under the drawing of the high-speed coagulating bath, then nascent fibers were fed into a water washing system, and the washed fibers were subjected to traction tension of 0.34 cN/dtex.

(3) The fibers washed in the step (2) were fed into a post-treatment system, and prepared into cellulose filament finished products through a pre-drying section, an oiling system, a main drying section and winding and filament collecting device, wherein the dried tows were subjected to traction tension of 0.25 cN/dtex.

Embodiment 6

In the embodiment, the continuous spinning of cellulose fibers at a speed of 1000 m/min was realized by adjusting the tension of the tows at each stage of preparation using the following continuous preparation method.

(1) Mixing, swelling and dissolving were carried out on cellulose pulp with the intrinsic viscosity of 270 mL/g and NMMO aqueous solution to prepare a spinning stock solution with the cellulose content of 11%, the spinning temperature was 125° C., extruding was carried out through a spinneret plate with the pore diameter of 0.04 mm of a spinneret assembly, through an air gap layer with the height of 120 mm, cooling was carried out under the conditions that cooling air was absolutely dry 10 g/kg dry air, the temperature of the air was 5° C. and the speed of the air was 35 m/s to obtain a fine solution stream, and the fine solution stream was subjected to a forming tension of 0.66 cN/dtex.

(2) The fine solution stream in the step (1) was enabled to enter a high-speed coagulating system, the speed of a coagulating bath was 1000 m/min, the spraying direction of the coagulating bath was consistent with the direction of the fine solution stream (tows), so that the fine solution stream was coagulated and formed under the drawing of the high-speed coagulating bath, then nascent fibers were fed into a water washing system, and the washed fibers were subjected to traction tension of 0.38 cN/dtex.

(3) The fibers washed in the step (2) were fed into a post-treatment system, and prepared into cellulose filament finished products through a pre-drying section, an oiling system, a main drying section and a winding and filament collecting device, wherein the dried tows were subjected to traction tension of 0.54 cN/dtex.

Embodiment 7

This embodiment was based on Embodiment 6, a cellulose pulp with an intrinsic viscosity of 270 mL/g was replaced with a mixture of two cellulose pulps with intrinsic viscosities of 220 mL/g and 320 mL/g, respectively, and other implementation modes of the embodiment were the same as in Embodiment 6.

Comparative Example 1

On basis of Embodiment 2, the tensions of tows at various stages of preparation were adjusted, and other implementation modes were the same as in Embodiment 2, specifically as follows.

In the comparative example, the fine solution stream was subjected to a forming tension of 2 cN/dtex, the washed tows were subjected to a traction tension of 1.6 cN/dtex, the dried tows were subjected to a traction tension of 2.3 cN/dtex, fibers can be prepared at a speed of 200 m/min basically, but the stability was poor, and fuzzing easily occurs.

Comparative Example 2

On basis of Embodiment 3, the tensions of tows at various stages of preparation were adjusted, and other implementation modes were the same as in Embodiment 3, specifically as follows.

In the comparative example, when the forming tension borne by the fine solution stream was not smaller than 2.0 cN/dtex, the tows were easy to break and cannot be loaded to a water washing roller; and when the forming tension borne by the fine solution stream was not greater than 0.08 cN/dtex, the tows cannot be separated from the coagulating bath. When the traction tension borne by the washed tows was not smaller than 1.6 cN/dtex, uninterrupted broken filaments appear on a drying roller, and the preparation stability and continuity were influenced; and when the traction tension borne by the washed tows was not greater than 0.07 cN/dtex, the tows were loosened, and the preparation continuity was influenced. When the traction tension borne by the dried tows was not smaller than 2.3 cN/dtex, the tows were easy to break, and the stable winding of filament cylinders fails; and when the traction tension borne by the dried tows was not greater than 0.02 cN/dtex, the tows rotate along with the drying roller, and the tows wind the roller.

Therefore, the selection of the tension values of each section and the matching of the tension values front and back influence the continuity and stability of preparation and the quality of the fibers.

Experiment Example 1

The fiber finished products prepared in Embodiments 1-6 and Comparative Example 1 were subjected to performance tests in which the dry tensile strength and the dry elongation were tested using GB/T 14344-2008, the yarn unevenness was tested using GB/T 14346-2015, the wet friction wear time can reflect the degree of fibrillation or the degree of anti-fibrillation of the fibers as determined by reference to FZ/T 52019-2018, and the test results were shown in the following table.

| | Dry tensile strength (cN/dtex) | Dry elongation (%) | Yarn unevenness (%) | Wet friction wear time (S) |
|---|---|---|---|---|
| Embodiment 1 | 4.10 | 7.53 | 2.34 | 20.12 |
| Embodiment 2 | 4.52 | 8.53 | 1.96 | 23.32 |
| Embodiment 3 | 4.23 | 7.78 | 1.40 | 21.05 |
| Embodiment 4 | 4.86 | 10.55 | 1.64 | 22.45 |
| Embodiment 5 | 3.76 | 7.34 | 2.06 | 18.73 |
| Embodiment 6 | 3.83 | 6.18 | 3.11 | 18.92 |
| Embodiment 7 | 3.82 | 6.18 | 3.10 | 18.94 |
| Comparative Example 1 | 3.55 | 5.91 | 8.13 | 10.2 |

As can be seen from the table, according to the efficient and continuous preparation method of cellulose fibers provided by the embodiment of the disclosure, the temperature of the spinning stock solution, the pore diameter of the spinneret plate, the air gap cooling height, the condition of air, the speed of the high-speed coagulating bath and the post-treatment system are comprehensively adjusted, so that the stable adjustment of the tension of each section of fiber preparation is realized, namely, the damage of the fibers is minimum, the degree of fibrillation is low, the uniformity and quality of the fibers are good, and the forming is more stable while realizing high-speed spinning and improving the production efficiency, so that the method is more suitable for industrial popularization.

The above descriptions are merely preferred embodiments of the disclosure rather than limitations to the disclosure in any form. Although the disclosure has been disclosed in preferred embodiments, it is not intended to limit the disclosure. Any one skilled in the art can make some changes or modifications to equivalent embodiments by using the above disclosed technical content without departing from the scope of the technical solution of the disclosure. Any simple amendments, equivalent changes or modifications made to the above embodiments according to the technical essence of the disclosure should fall in the scope of the technical solution of the disclosure, without departing from the content of the technical solution of the disclosure.

What claimed is:

1. A continuous preparation method of cellulose fibers, wherein in the preparation method, a forming tension of 0.1 to 1.9 cN/dtex is applied to a fine solution stream obtained by extrusion through a spinneret plate and air gap cooling, then the fine solution stream is fed into a coagulating bath at a speed of 80 to 1000 m/min, a traction tension of 0.075 to 1.5 cN/dtex is continued to be applied to washed fibers in a water washing system after the coagulating bath, and finally, the washed fibers are fed into a post-treatment system for continuous spinning to obtain finished fibers, wherein a spraying direction of the coagulating bath is consistent with a running direction of the fine solution stream, the coagulating bath further comprises a coagulating bath water tank disposed at an outlet of tows, the coagulating bath water tank comprises a filament guide system, and the outlet of tows is disposed vertically extending downwards into the water tank, or is disposed along a liquid level of the water tank, or is disposed bending upwards along a liquid level of the water tank, or is disposed bending upwards from a position lower than a liquid level of the water tank, or is disposed higher than a liquid level of the water tank, so that the fiber tows passing through the coagulating bath are completely immersed, or partially immersed, or do not pass through the coagulating bath water tank; a soaking length of the fiber tows through the coagulating bath is 50 to 1500 mm; the coagulating bath water tank is provided with a filament guide system, a filament guide part of the filament guide system comprises one or more of driving double rollers, a single-roller combined filament separating roller, a rod and a hook; the driving double rollers or single roller is provided with a motor, and the rotating speed of the roller is the spinning speed; respective axis extension lines of the driving double rollers are intersected, and a number of winding turns of the tows on the driving rollers is not smaller than three; the filament guide system is installed below an outlet of the coagulating bath.

2. The continuous preparation method of cellulose fibers according to claim 1, wherein in the preparation method, a temperature of a spinning stock solution, a pore diameter of the spinneret plate and an air gap cooling condition are adjusted according to a speed of the coagulating bath, meanwhile, process conditions of the post-treatment system are adjusted, so that the cellulose fibers are subjected to tension suitable for all preparation stages, and the finished fibers are continuously spun by tows at a spinning speed of 80 to 1000 m/min.

3. The continuous preparation method of cellulose fibers according to claim 2, in the preparation method, a forming tension of 0.15 to 0.65 cN/dtex is applied to a fine solution stream obtained by extrusion through a spinneret plate and air gap cooling, then the fine solution stream is fed into a coagulating bath at a speed of 200 to 800 m/min, a traction tension of 0.1 to 0.6 cN/dtex is continued to be applied to washed fibers in a water washing system after the coagulating bath, and finally, the washed fibers are fed into a post-treatment system to obtain finished fibers.

4. The continuous preparation method of cellulose fibers according to claim 1, wherein the post-treatment system comprises two independent working sections for preparing cellulose filaments or cellulose staple fibers;

the working section of the cellulose filaments comprises an oiling system and a drying section which are sequentially disposed, and then the treated fibers are wound into a filament cylinder finished product; the working section of the cellulose filaments comprises a pre-drying section, an oiling system and a main drying section which are sequentially disposed;

the working section of the cellulose staple fibers comprises a cutting section, a water washing section, an oiling system, a drying section and a packaging section which are disposed in sequence.

5. The continuous preparation method of cellulose fibers according to claim 4, wherein when the cellulose filaments are prepared, dried tows are subjected to a traction tension of 0.025 to 2.25 cN/dtex.

6. The continuous preparation method of cellulose fibers according to claim 1, wherein the spraying direction of the coagulating bath is parallel to the running direction of the fine solution stream.

7. The continuous preparation method of cellulose fibers according to claim 1, wherein a soaking length of the fiber tows through the coagulating bath is 100 to 350 mm.

8. The continuous preparation method of cellulose fibers according to claim 1, wherein a spinning stock solution is prepared by mixing, swelling and dissolving cellulose pulp and NMMO aqueous solution, an intrinsic viscosity of the cellulose pulp is not higher than 600 mL/g, and the cellulose is selected from pulp with single intrinsic viscosity and is also obtained by mixing cellulose pulp with difference in intrinsic viscosity; a cellulose content in the spinning stock solution is 5 to 15 wt %; and a temperature of the spinning stock solution is 90 to 130° C.

9. The continuous preparation method of cellulose fibers according to claim 2, wherein the pore diameter of the spinneret plate is 0.04 to 0.3 mm.

10. The continuous preparation method of cellulose fibers according to claim 1, wherein an adjustment range of an air gap cooling height in the air gap cooling condition is 10 to 200 mm, a humidity of a cooling air is absolutely dry 3 to 15 g/kg dry air, a temperature of the cooling air is 5 to 28° C., and a speed of the cooling air is 3 to 35 m/s.

11. The continuous preparation method of cellulose fibers according to claim 2, wherein the spinning speed is not smaller than the speed of the coagulating bath.

12. The continuous preparation method of cellulose fibers according to claim 3, wherein the spinning speed is higher than the speed of the coagulating bath.

13. The continuous preparation method of cellulose fibers according to claim 3, wherein the fine solution stream is subjected to the forming tension of 0.2 to 0.6 cN/dtex, the washed fibers are subjected to the traction tension of 0.15 to 0.55 cN/dtex, and tows are continuously spun into the finished fibers at the spinning speed of 200 to 800 m/min through the preparation method.

14. The continuous preparation method of cellulose fibers according to claim 5, wherein the dried tows are subjected to a traction tension of 0.06 to 1 cN/dtex.

15. The continuous preparation method of cellulose fibers according to claim 1, wherein the filament guide part is the driving double rollers.

16. The continuous preparation method of cellulose fibers according to claim 8, wherein the intrinsic viscosity of the cellulose pulp is 270 to 500 mL/g, the cellulose content in the spinning stock solution is 7 to 13 wt %, the temperature of the spinning stock solution is 100 to 125° C.

17. The continuous preparation method of cellulose fibers according to claim 9, wherein the pore diameter of the spinneret plate is 0.08 to 0.2 mm.

18. The continuous preparation method of cellulose fibers according to claim 10, wherein the adjustment range of the air gap cooling height in the air gap cooling condition is 35 to 125 mm, the humidity of the cooling air is absolutely dry 4 to 10 g/kg dry air, the temperature of the cooling air is 14 to 24° C., and the speed of the cooling air is 3.5 to 10 m/s.

* * * * *